US005586390A

United States Patent [19]

Barr

[11] Patent Number: 5,586,390

[45] Date of Patent: Dec. 24, 1996

[54] METHOD OF MAKING JEWELRY ARTICLES

[76] Inventor: Josef J. Barr, 777 W. Flagler Dr., West Palm Beach, Fla. 33402

[21] Appl. No.: 498,033

[22] Filed: Jul. 3, 1995

[51] Int. Cl.[6] ..... A44C 25/00; A44C 5/00; B21F 43/00

[52] U.S. Cl. ..... 29/896.411; 29/896.4; 29/896.43; 63/2; 63/3

[58] Field of Search ..... 29/896.411, 896.43, 29/896.4, 896.41; 63/2, 3

[56] References Cited

U.S. PATENT DOCUMENTS

| | | | |
|---|---|---|---|
| 91,813 | 6/1869 | Baeuerle | 29/896.4 |
| 294,010 | 2/1884 | Charnley | 63/3 |
| 958,641 | 5/1910 | Heeren | 29/896.41 |
| 1,189,882 | 7/1916 | Sommer | 63/3 |
| 1,361,704 | 12/1920 | Fishel | 29/896.41 |
| 1,634,562 | 7/1927 | Shapiro . | |
| 1,821,577 | 9/1931 | Povalski | 29/896.4 |
| 1,933,576 | 11/1933 | Weed | 63/3 |

*Primary Examiner*—P. W. Echols
*Attorney, Agent, or Firm*—Charles E. Temko

[57] ABSTRACT

A method of manufacturing articles of jewelry such as bracelets of curved planar configuration which permits substantial savings of precious metal materials. The method includes the use of a corresponding punch and die set to form the material from planar stock 0.008 to 0.020 inches thick to obtain a planar stamping, and the securing of a corresponding stamping of lining material, also of precious metal, within the hollow article so as to add rigidity and mechanical strength. In an alternate form, the lining material is formed integrally with the stamping and bent about the peripheral edges to form the liner.

2 Claims, 2 Drawing Sheets

METHOD OF MAKING JEWELRY ARTICLES

BACKGROUND OF THE INVENTION

This invention relates generally to the field of manufacture of precious metal jewelry, and more particularly to the manufacture of articles of generally planar or curved articles such as bracelets and the like. Traditionally, most jewelry articles of this type have been formed by casting, using the so-called lost wax method. Such casting can be formed to include hollow portions in order to use less precious metal materials. However, such castings require a minimum thickness to assure sufficient mechanical strength, and as a result, material costs are relatively high. It is, of course, known in the art to form such articles from base metals and apply a covering ranging from a simple gold wash to a plating of substantial thickness. Such articles cannot be advertised or sold as gold jewelry, and, where the covering is relatively thin, the useful life of such articles is quite limited.

The shaping of various articles using corresponding punch and die sets and planar stock is a common expedient, but has been used in the jewelry art only to a very limited degree. The principal reason for such limited use lies in the fact that most precious metals are relatively soft and in thin section they are readily damaged.

SUMMARY OF THE INVENTION

Briefly stated, the invention contemplates the manufacture of precious metal articles of jewelry of generally planar configuration, in which the same are formed by a mating die set using relatively thin precious material sheet stock. Because of the relatively high ductility of the precious metal used, particularly gold sheets, relatively intricate configurations can be obtained without difficulty. Once formed, the rigidity of the finished article is increased to an acceptable level by providing a stiffening liner bordering the edges of the article which is soldered to the inner surface of the stamping. In another embodiment, the liner is formed by bending over the longitudinal and end edge areas of the stamping to create first and second peripheral edges using progressive dies which create an apparent increased thickness in the article.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
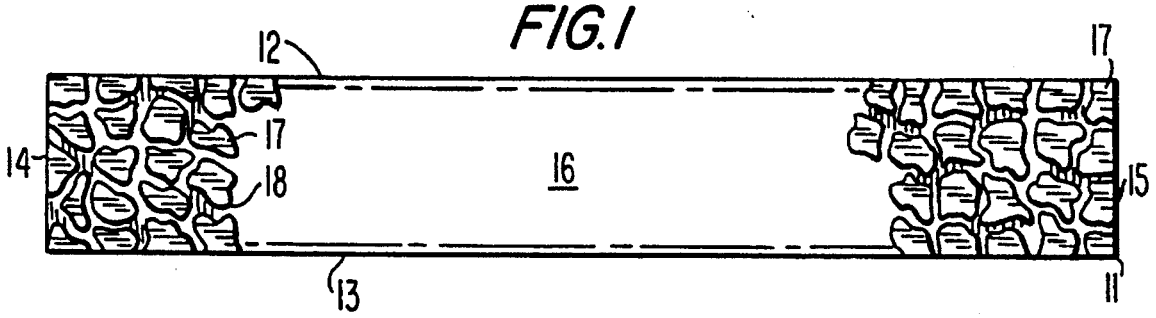
FIG. 1 is a plan view of a planar stamping showing a first step in the disclosed method embodying the invention.

Referring to FIG. 1 in the drawing, the device 10 (FIG. 3) is formed from an elongated stamping 12 of planar precious metal, i.e. 14 karat gold, having a thickness ranging from 0.008 to 0.020 inch. The stamping 11 is bounded by first and second side edges 12 and 13, first and second end edges 14 and 15 and an outer surface 16. A design relief, such as simulated nuggets 17 are formed during the stamping process, the same being separated by depressed interstices 18, as is known in the art. It will be understood that the design illustrated may be replaced by other desired designs within the scope of the invention.

Figure 2:
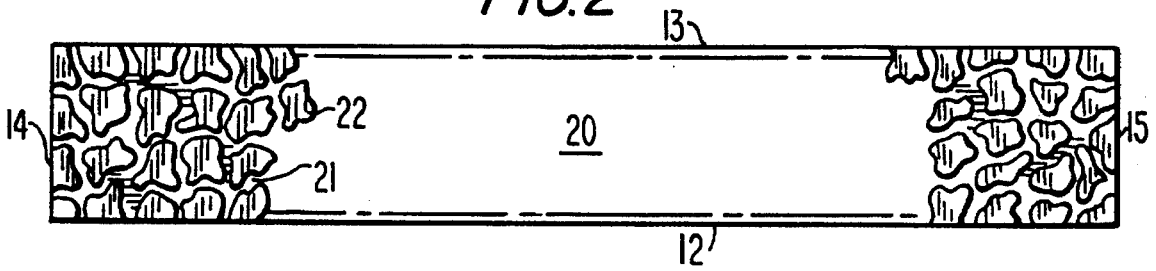
FIG. 2 is a bottom plan view thereof showing the surface opposite that seen in FIG. 1.

Referring to FIG. 2, the stamping 11 includes a corresponding inner surface 20 in which the interstices 21 are in relief and the simulated nuggets 22 are depressed.

Figure 3:
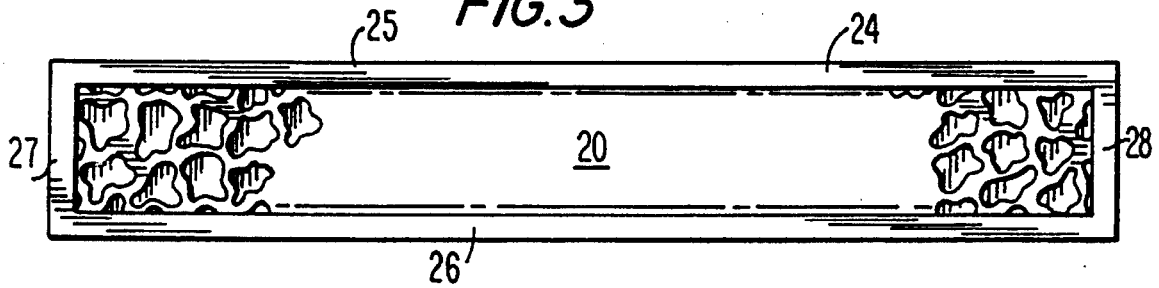
FIG. 3 is a bottom plan view similar to that seen in FIG. 2 showing the incorporation of a peripheral liner.
Figure 4:
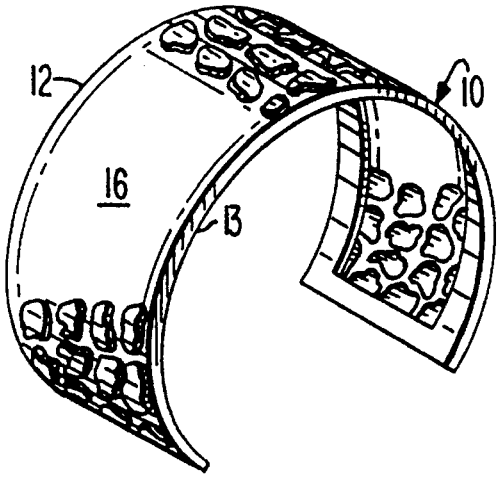
FIG. 4 is a perspective view of the article in finished configuration.

In a subsequent step shown in FIG. 3, a peripheral liner 24 is also prepared as a stamping operation, the liner including a pair of side members 25 and 26 and end members 27 and 28. The liner is prepared from similar sheet stock in which one surface (not shown) has been coated with a suitable flux to facilitate soldering. Again, a thickness ranging from 0.010 to 0.020 inch is also suitable in forming the liner, although where the stamping 11 is at the thinner end of the range, the liner may be at the thicker end of the range to provide adequate stiffening and mechanical strength. When positioned as shown in FIG. 3, the assembly is placed in an oven to effect an overall soldering operation between the stamping and the liner, and subsequently allowed to cool. Following the soldering step, the integrated assembly may be polished in normal manner and bent to desired configuration, i.e. to an open oval to form a bracelet or similar article.

Obvious modifications are possible. For example, the liner may be made of metal of lower karat, or of a non-precious metal or alloy. I have found a preferred thickness for the stamping 11 to be approximately 0.012 inch which allows maximum saving of material with minimum loss of mechanical strength.

Figure 5:
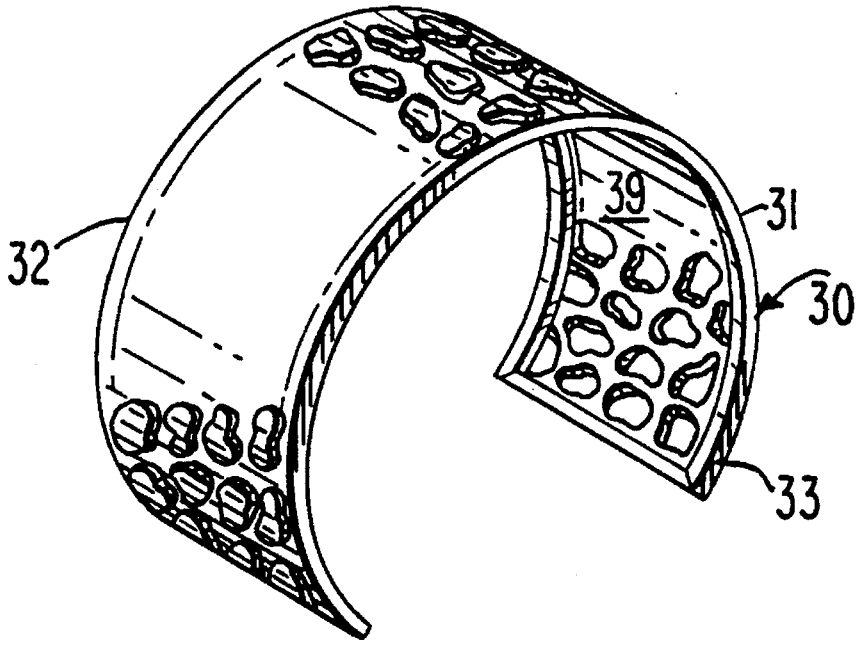
FIG. 5 is a perspective view showing an alternate method embodying the invention.
Figure 6:
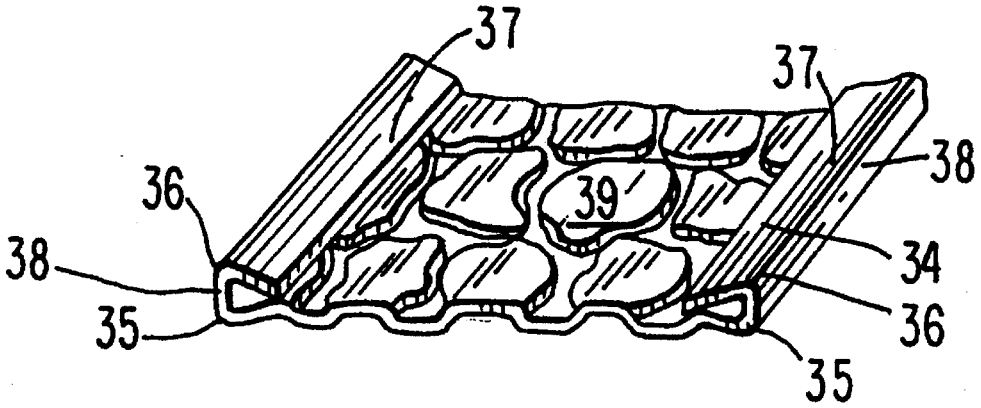
FIG. 6 is an enlarged fragmentary perspective view, partly in section, showing the alternate method.

FIGS. 5 and 6 illustrate an alternate method of forming the jewelry article in which the liner is formed by bending over the longitudinal and end edges of the stamping in a progressive die operation to form first and second fold edges to give the appearance of substantial thickness.

Thus, in the alternate method, a finished article 30 includes longitudinal side edges 31 and end edges 32 which are formed using additional material 33 formed integrally during the initial stamping operation, which material forms the liner 34. As seen in FIG. 6, the material is progressively formed to include a first fold edge 35 and a second fold edge 36, each approximately 90 degrees, thus providing a radially oriented peripheral portion 37 and a cylindrical portion 38 which overlies the inner surface 39 of the article. This procedure eliminates the necessity of edge polishing of the finished article to conceal the no longer present solder joint between the stamping and the liner as in the principal method.

It may thus be seen that I have invented novel and highly useful improvements in a method of manufacturing precious metal jewelry articles, in which, by the use of mating male and female die sets, it is possible to form the article to a cross-sectional thickness far below that possible using the traditional lost wax method. Instead of forming the article as a single element, it is formed as a relatively thin stamping with a peripherally arranged soldered liner to provide adequate shape retaining qualities and mechanical strength. The savings in precious metal allow the cost of materials to be reduced by over one-half. Because the die sets may be used repeatedly as contrasted from the single use lost wax mold, labor costs are also reduced by an order of magnitude. In an alternate form, the liner is formed integrally with the stamping and subsequently formed by folding to provide a thickened edge.

I wish it to be understood that I do consider the invention to be limited to the precise details shown and set forth in the specification, for obvious modifications will occur to those skilled in the art to which the invention pertains.

I claim:

1. The method of forming a generally planar article of jewelry which comprises the steps of:

a) providing a planar sheet of precious metal of thickness ranging from 0.008 to 0.020 inch;

b) using a corresponding male and female die set, stamping a portion of said sheet to form an article of overall rectangular configuration including a design in relief, and, including additional peripheral material along the longitudinal and end edges thereof;

c) bending said additional peripheral material through substantially 180 degrees to form a peripheral reenforcing liner to increase the effective thickness of said article at the periphery thereof.

2. The method in accordance with claim 1, in which said peripheral material is folded to form a pair of right angle folds of approximately 90 degrees each.

* * * * *